United States Patent [19]

Milian

[11] Patent Number: 4,826,051

[45] Date of Patent: May 2, 1989

[54] MANIFOLD BLASTER

[76] Inventor: Saul Milian, 1855 W. 62 St., Apt. 307, Hialeah, Fla. 33012

[21] Appl. No.: 544,736

[22] Filed: Oct. 24, 1983

[51] Int. Cl.[4] ..... B67B 7/24

[52] U.S. Cl. ..... 222/195; 222/630; 222/518

[58] Field of Search ..... 222/195, 511, 518, 630

[56] References Cited

U.S. PATENT DOCUMENTS

| | | | |
|---|---|---|---|
| 3,788,527 | 1/1974 | Matson | 222/195 |
| 3,929,261 | 12/1975 | Solimar | 222/195 |
| 4,165,820 | 8/1979 | Dugge et al. | 222/195 X |
| 4,400,131 | 8/1983 | Blake | 222/195 X |

FOREIGN PATENT DOCUMENTS

| | | | |
|---|---|---|---|
| 0951692 | 7/1976 | Canada | 222/195 |
| 2727542 | 1/1979 | Fed. Rep. of Germany | 222/195 |

OTHER PUBLICATIONS

Big Blaster Air Cannon, Owners/Operators Manual, Martin Engineering Company, no available date—222/195.

*Primary Examiner*—Joseph J. Rolla
*Attorney, Agent, or Firm*—J. Sanchelima

[57] ABSTRACT

A blasting device for pulverizing material being fed through a hopper connected to a supply of pressurized gas. The blasting device comprises a housing member including an intake opening connected to the supply, an output opening connected to the inside of the hopper and a top opening. A tubular member connected to the output opening on one end are disposed within the housing member so that two compartments are defined. A cap member cooperatively and hermetically sealing the top opening thereby defining a third compartment. A diaphragm/valve member sandwiched between the peripheral underside of the cap member and the top opening of the housing, including a spring biased assembly urging the valve member downwardly in contact with the other end of the tubular member thereby separating the two compartments. Conduit means connecting the supply to the third compartment. Valve means for opening and closing the third compartment. A plurality of blasting devices may be connected to a common supply of pressurized air through a manifold.

6 Claims, 1 Drawing Sheet

MANIFOLD BLASTER

BACKGROUND OF THE INVENTION

1. Field of the Invention

The present invention relates to manifold blasters, and more particularly, to those blasters that are used to pulverize the particulate matter in a hopper.

2. Description of the Prior Art

Several attempts have been made in the past to solve the problem of compacted particulate matter in a hopper. One of these attempts is disclosed in U.S. Pat. No. 3,788,527 issued to Matson. Here, an air cannon or blaster is disclosed which comprises a supply of compressed gas and a valve/piston assembly. The valve/piston assembly, however, requires periodic lubrication of the O-ring around the piston, making its reliability low. When the pressurized air supply is disconnected, it is possible for the bulk material to penetrate inside the tank through the outlet opening connected to the hopper. Matson's device requires the addition of an air lubricator to the pressurized gas supply. Therefore, Matson's device is recommended to be pointed downwardly to prevent bulk material from entering inside the device. This limits its usefulness. The present invention, on the other hand, efficiently provides for the release of a volume of compressed air through a diaphragm/valve mechanism that requires very little maintenance since the outlet opening is normally closed even when there is no pressurized gas supply connected. Also, Matson's device requires the use of an expensive two-way valve whereas the present invention uses any valve.

Also, other patents showing other devices that have tried to solve the problem in the industry are listed below.

| | | |
|---|---|---|
| 3,788,527 | QUICK-RELEASE AERATOR FOR INTRODUCING HIGH PRESSURE AIR INTO A CONTAINER TO FACILITATE DISPENSING | Carl G. Matson |
| 4,039,431 | PARTICULATE MATERIAL DISTRIBUTOR AND METHOD INVOLVING USE OF SAME | Lloyd A. Baillie |
| 2,425,419 | BLUST DUSTER | Albert Roscoe Carnes |
| 3,304,647 | DUSTER DEVICES | George Szekely |
| 3,252,656 | SPRAY DISCHARGE HEAD | Leon D. Greenwood |
| 3,369,754 | METHOD AND APPARATUS FOR UNIFORMLY DISTRIBUTING TREATMENT MATERIAL BY AIR | Dale E. Wolford |
| 4,280,419 | PNEUMATIC SYSTEM FOR CONVEYING GRANULAR MATERIAL | Raymond C. Fischer |
| 3,948,443 | METHOD AND APPARATUS FOR SPREADING GRANULAR MATERIAL, ESPECIALLY FERTILIZER | Bjarne Omdal & Johs Skaadel |
| 3,717,752 | PARTICLE SPRAYING DEVICE | Walter B. Warning |

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a device that may be easily installed on the lateral walls of a hopper and provide a blast inside so that the compacted bulk material being processed may be broken down or aerated to facilitate its flow.

It is still another object of the invention to provide a blasting device where the outlet opening is normally closed, including when the pressurized air supply is disconnected thereby preventing the entrance of bulk material inside the device.

It is another object of the present invention to provide such a blaster that is virtually maintenance free, reliable and inexpensive to manufacture.

Still another object is to provide a compact blaster device, of small dimensions, that may be installed in remote areas.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
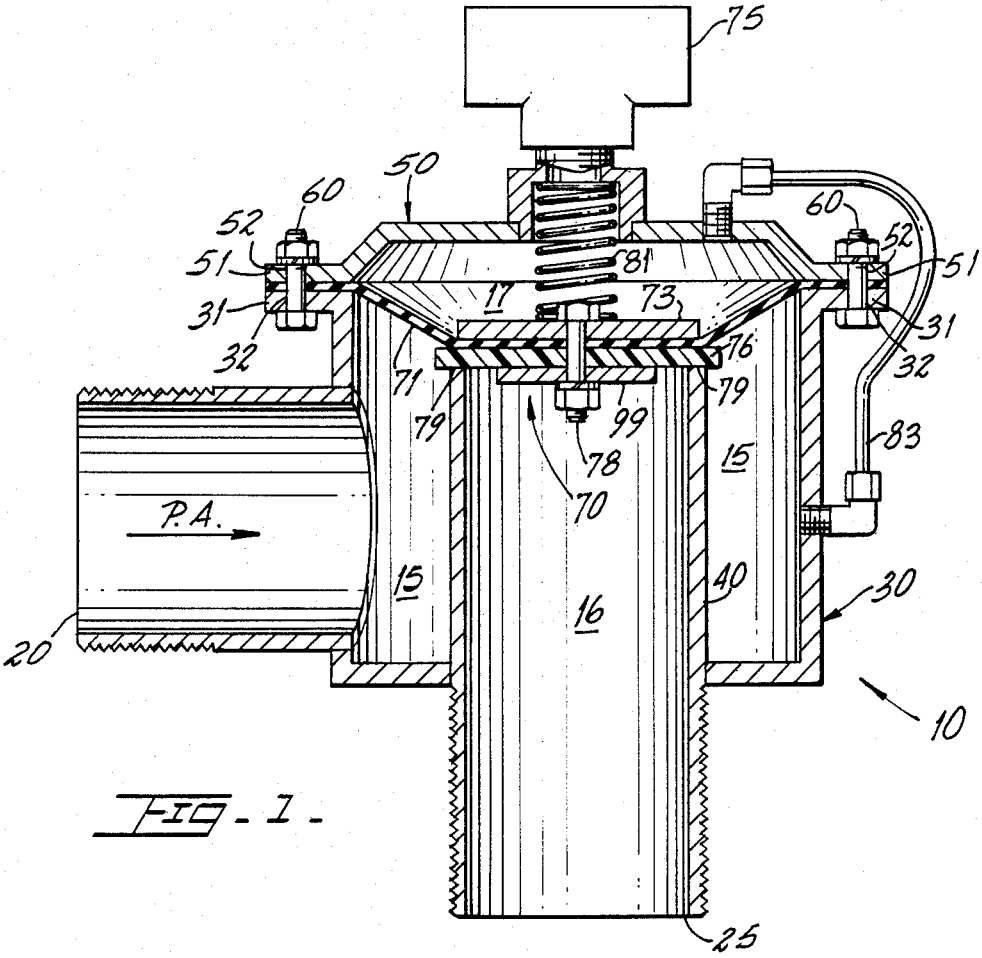
FIG. 1 is a cross-section of the blaster showing the diaphragm/valve assembly.

Referring now to FIG. 1 where the present invention has been referred to generally with numeral 10, it can be observed that it comprises a housing including intake opening 20 and outlet opening 25 and a cap member 50. In the preferred embodiment housing 30 has a substantially cylindrical shape having two compartments divided by a centrally and coaxially disposed tubular member 40. The first compartment 15 being the space between the inner surface of housing 30 and the outer surface of tubular member 40. The second compartment 16 being the inside space of tubular member 40. The upper end of cylindrical housing 30 is open and it is provided with a peripheral flange 31 which extends outwardly perpendicularly to the centerline of cylindrical housing member 30. A cap member 50 rests over housing member 30, on cooperating outward flange 51. Both, flanges 31 and 51, are provided with a plurality of coinciding holes 32 and 52 through which fastening means 60 are connected.

Sandwiched between flanges 31 and 51 is diaphragm/valve assembly 70 which includes flexible sheet 71, valve member 76 and metal backing members 73 and 99. Basically, sheet 71 has a plurality of hole around its periphery that coincide with the holes 32 and 52 of flanges 31 and 51. Sheet 71 is made out of a flexible, fatigue-resistant material and it is provided with a flat valve member 76 mounted on its underside. Valve member 76 is of sufficient size to cover to upper open end of tubular member 40 by coming into contact at valve seat 79. In the preferred embodiment, valve member 76 is made out of a self-lubricating, high abrasion resistance, low friction coefficient, impact-resistant and non-adherent material, such as polyethylene. The upper side of sheet member 71 has a first flat metal backing member 73, of somewhat smaller size than valve member 76 and being intended to provide structural stability to the diaphragm/valve assembly 70. Below and adjacent to valve member 76 a second flat backing member 99 is mounted also to provide structural stability to valve assembly 70. Fastening means 78 hold the above mentioned components together. A compressed spring 81 acts on the upper surface of backing member 73 urging diaphragm/valve assembly 70 downwardly so that valve member 76 rests of valve seat 79.

A solenoid valve 75, a valve actuated by a solenoid, is used in the preferred embodiment but a manually actuated valve would give the same results. Valve 75 is designed to open up cap compartment 17 to the exterior. Conduit means 83 interconnect first compartment 15 with cap compartment 17.

The operation of device 10 is as follows: a constant supply of pressurized air PA is connected to intake opening 20, FIG. 1, filling compartment 15 with pressurized air. Compartment 15 is connected to cap compartment 17 through conduit 83 which fills cap compartment 17 with pressurized air a few instants after the PA maximum pressure is achieved at compartment 15. The time required for compartment 17 to reach the pressure of compartment 15 depends on the diameter of conduit 83 and the capacity of compartment 17. Diaphragm/valve assembly 70 separates first compartment 15 from cap compartment 17 and the force (pressure times area) from both of these compartments is offset by each other's equal and opposing forces. Therefore, the only net resulting force acting on diaphragm/valve assembly 70 is that of spring 81 which urges assembly 70 downwardly, closing upper tubular member 40. Now, when valve 75 is activated, the pressurized gas in cap compartment 17 escapes, suddenly dropping the pressure in this compartment, thereby causing a differential in pressures between compartments 15 and 17. Since the area is constant throughout, the resulting force is a proportional function of the pressure differential between compartments 15 and 17. The resulting force will urge diaphragm/valve assembly 70 upwardly, overcoming the opposing force of spring 81. This causes valve member 76 to separate from valve seat 79 causing pressurized compartment 15 to connect with second compartment 16 which in turn is connected to the interior of the hopper H, in FIG. 2, through outlet opening 25. When valve 75 closes again, the pressure inside cap compartment 17 builds up again in time, as a function of the diameter of conduit 83 so that it closes valve 76 when the pressure (or force) in compartment 17 and the spring 81 force, combined, is enough to counter act the pressure (force) in compartment 15.

Figure 2:
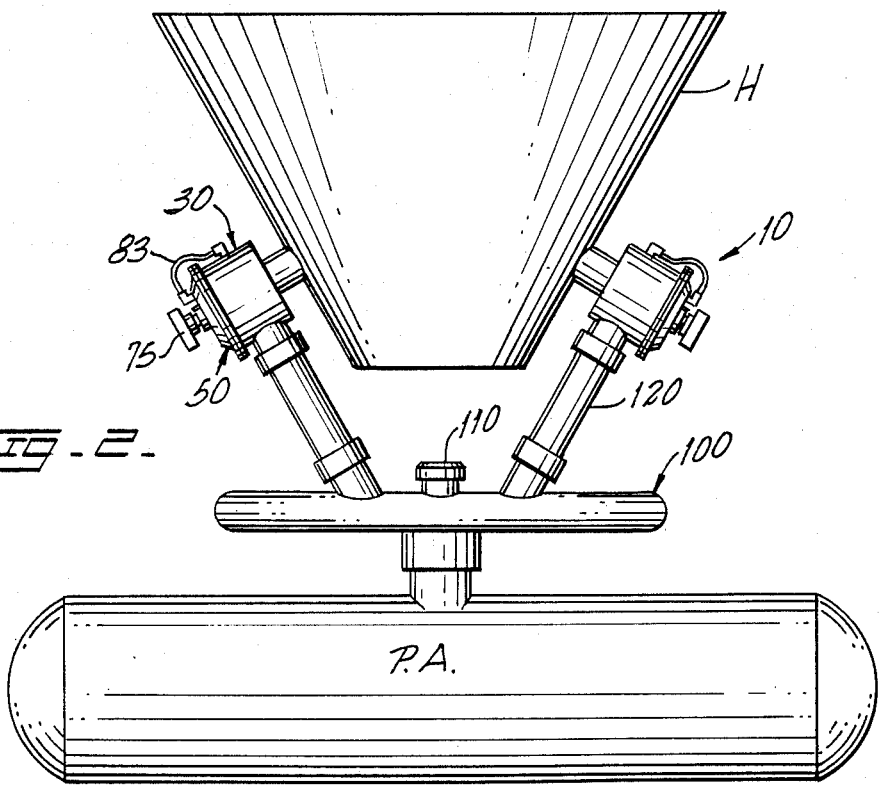
FIG. 2 shows the device of the present invention connected to two outlets of a manifold connected to a supply of compressed air.

As can be seen from FIG. 2, several devices 10 can be installed on a manifold 100 that is in turn connected, through conduit means 120, to a supply of pressurized gas. Conduit means 120 may be rigid or flexible depending on the circumstances. This facilitates the installation of several blasting devices 10 on a hopper H facilitating the pulverization of the compacted granular material being processed. The unused outlets 110 of manifold 100 may be capped off.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A blasting device for aerating material being fed through a hopper connected to a supply of pressurized gas, comprising, in operative combination:

A. a housing member including an intake opening connected to said supply, an output opening connected to the inside of said hopper and a top opening;

B. a tubular member connected to said output opening on one end is disposed within said housing member so that two compartments are defined;

C. a cap member cooperatively and hermetically sealing said top opening;

D. a diaphragm/valve member sandwiched between the peripheral underside of said cap member and the top opening of said housing, thereby defining a third compartment including a spring biased assembly urging said valve member downwardly in contact with the other end of said tubular member thereby separating said first and second compartments from said third compartment;

E. conduit means connecting said supply to said third compartment;

F. valve means for opening and closing said third compartment.

2. The blasting device set forth in claim 1 wherein said housing member has a substantially cylindrical shape and said tubular member is coaxially disposed with respect to said housing member.

3. The blasting device set forth in claim 2 wherein said tubular member has a circular cross-section.

4. The blasting device set forth in claim 3 wherein said diaphragm/valve member includes a flexible sheet having a flat valve member on its underside and a backing member on its upperside so that the force exerted by said spring is indirectly applied to said valve member through said backing member.

5. The blasting device set forth in claim 4 wherein said valve member is made out of polyethylene.

6. The blasting device set forth in claim 1 further including:

G. a manifold member having its intake connected to said supply and having its outlets connected to the intake openings of a plurality of said blasting devices.

* * * * *